United States Patent [19]

Dusch et al.

[11] Patent Number: 4,677,926

[45] Date of Patent: Jul. 7, 1987

[54] POSITIONING DEVICE FOR SEWING MACHINE MAIN SHAFT

[75] Inventors: Albert Dusch; Erich Willenbacher, both of Kaiserslautern, Fed. Rep. of Germany

[73] Assignee: Pfaff Industrie Maschinen GmbH, Fed. Rep. of Germany

[21] Appl. No.: 818,119

[22] Filed: Jan. 10, 1986

[30] Foreign Application Priority Data

Jan. 11, 1985 [DE] Fed. Rep. of Germany ..... 8500520

[51] Int. Cl.[4] ..... D05B 69/22; D05B 69/08

[52] U.S. Cl. ..... 112/274; 112/221; 112/276

[58] Field of Search ..... 112/67, 274, 276, 221

[56] References Cited

U.S. PATENT DOCUMENTS

| | | | |
|---|---|---|---|
| 1,850,708 | 3/1932 | Davis | 112/276 |
| 2,088,266 | 7/1937 | Jafferian | 112/274 X |
| 3,026,835 | 3/1962 | Hall | 112/276 X |
| 4,423,692 | 1/1984 | Kelly et al. | 112/276 X |
| 4,515,098 | 5/1985 | Walther | 112/276 |

*Primary Examiner*—Werner H. Schroeder
*Assistant Examiner*—Andrew M. Falik
*Attorney, Agent, or Firm*—McGlew and Tuttle

[57] ABSTRACT

A drive device for positioning a sewing machine main shaft and driven by a positioning motor into a needle-up position when it is stopped for example, after the thread is cut comprises a removable drive lever member which has a tappet portion which engages wtih the shoulder of a cam which is mounted on the main shaft for rotation therewith. The drive lever is driven by a device such as a fluid pressure operated piston cylinder combination and when it moves the tappet engages the cam face and rotates the cam with the main shaft to a second position which is predetermined. The mechanism also includes a stop which is effected between a face of the cam and a lever member which is shifted by the drive lever to stop the backward movement of the cam with the main shaft at a precise second position.

5 Claims, 4 Drawing Figures

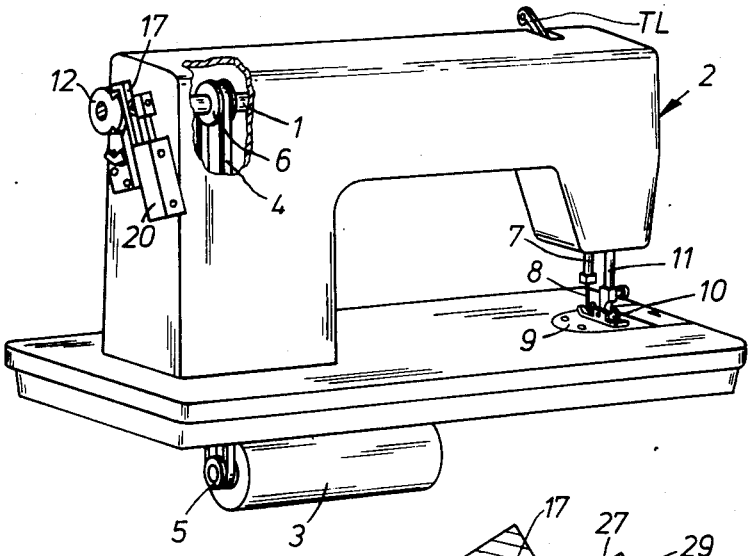
Fig. 1
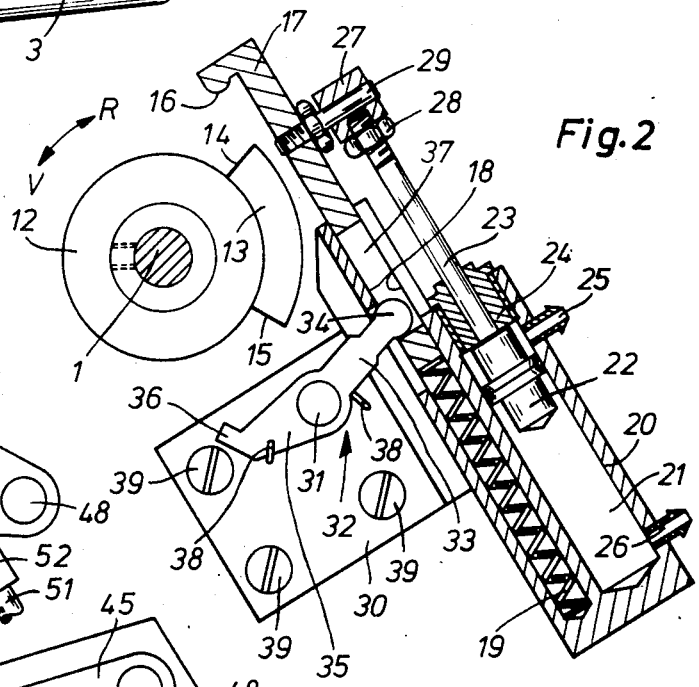
Fig. 2
Fig. 3
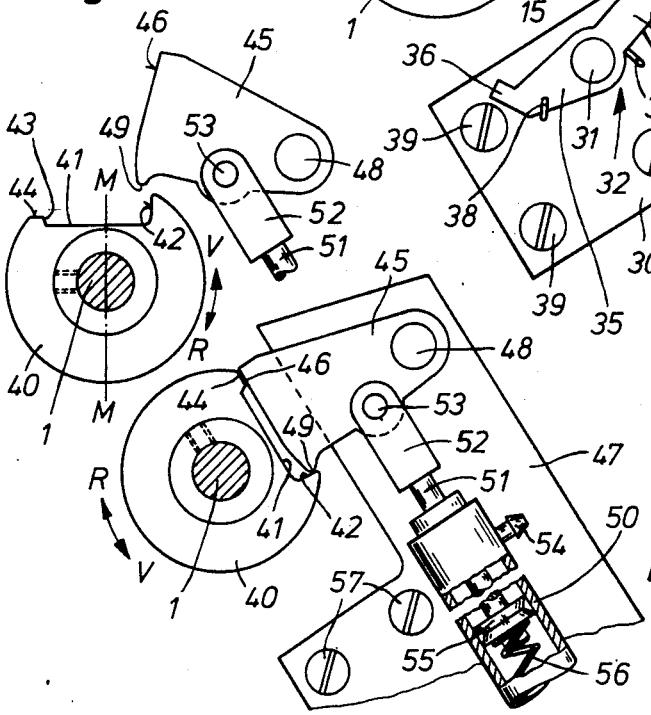
Fig. 4

POSITIONING DEVICE FOR SEWING MACHINE MAIN SHAFT

FIELD AND BACKGROUND OF THE INVENTION

This invention relates in general to sewing machines and in particular to a new and useful drive device for positioning a sewing machine main shaft when its positioning motor drive is stopped, for example, to cut a thread.

In certain cases it is necessary to turn the sewing machine back, after having stopped it in a certain position, e.g. in needle-up or needle-down position, by a certain angle of the main shaft into another position. This applies for instance to chain stitch sewing machines where the shuttle has penetrated into the needle thread loop in the needle-up position and must be moved out of it to be able to remove the work unhindered at the end of a seam.

In backstitch sewing machines, the thread feeding lever of the needle bar lags by about 30° behind the main shaft rotation, i.e. the needle bar, having passed through its highest position, is already moving downwardly while the thread lever is still moving upwardly. Because of this situation resulting from the sewing practice, it may be that when the sewing machine is stopped in needle-up position after the cutting of the thread and if the thread end is not clamped or retained, the thread is pulled out of the eye of the needle, as the sewing machine is started again, by the upwardly moving thread feeding lever, the start of sewing being thus delayed by the rethreading. For this reason often the thread lever up position is chosen as the stopping position after the after the cutting of the thread. But since the needle bar has then already moved downward by a certain distance, the passage space under the needle is, in many cases, too small to be able to remove or to insert the work unhindered. The seamstress must then grip the handwheel and turn the machine back by a certain angle to the needle-up position. This, however, is complicated and time consuming.

From German Pat. No. 910,023 a device for driving and stopping a sewing machine in predetermined positions is known where the stopping process occurs in that the sewing machine main shaft is first switched from full speed to a lower speed, at which it is advanced to a predetermined position and stopped there, whereupon it is automatically rotated back by a certain angle and again stopped. The change of speed and direction occurs directly at the drive motor. Such a drive is relatively complicated and expensive. Nor is it needed for all sewing machines and sewing processes.

Through German GM No. 81 24 815 a drive device to be retrofitted to sewing machines is known where, besides the V-belt pulley of the drive motor of the sewing machine, a driver disk is provided with a clutch disk. One of the device has a thread disposed on a threaded spindle adapted for rotation in the belt guard with adjustable tightness of motion. The other model has a cylindrical bearing bore and is arranged on a bearing pin which is also adapted for rotation in the belt guard with adjustable tightness of motion. A cross pin is inserted into the bearing pin and it protrudes into an oblique slot in the hub of the clutch disk. For rotating the clutch disk a pneumatic cylinder is used, whose piston rod engages at a crank arm of the clutch disk.

To turn the stopped sewing machine back into thread lever up position after the thread has been cut, compressed air is supplied to the pneumatic cylinder, whereby the clutch disk is rotated by a certain angle counter to the normal running direction of the motor shaft. In so doing, the one model of the clutch disk is displaced by the thread pitch, and the other model by the inclination of the oblique slot, at first axially into engagement with the drive disk and then, in the further course of the roration, the sewing machine is turned back into the needle-up position through the belt drive.

This device does indeed operate with a good stopping precision and can be uncoupled quickly enough for continued sewing, but it is quite complicated in construction and must be readjusted from time to time because of the abrasion at the clutch and driver disks.

SUMMARY OF THE INVENTION

The invention provides a drive motor for a sewing machine where simple and inexpensive structural elements are used for turning the sewing machine into reverse from a predetermined stopping position into another stopping position. The component parts of the drive motor and can be installed subsequently in all sewing machine types driven by positioning motors.

In accordance with the invention the sewing machine is provided with a separately driven drive lever which is moved so that a driver cam of the drive lever engages a stop face of a cam which is secured to the main shaft of the sewing machine. Continued movement of the drive lever under its own or separate power rotates the drive shaft back to a predetermined setting position, and this end position is also determined by an opposite face of the cam which engages against a positioning lever which is moved by the drive lever.

Due to the special mutual correlation of the stops, of the tappet, and of the shoulder, the parts block one another in the second stopping position, so that rebounding upon stoppage is prevented by the positive connection and thereby a high stopping precision is achieved by simple means. The device operates practically wear-free and can be retrofitted to all machines driven by a positioning motor.

Accordingly, it is an object of the invention to provide an improved mechanism for rotating a main shaft of a sewing machine back to a predetermined setting position after it has been stopped.

A further object of the invention is to provide a separate drive for a sewing machine to rotate a shaft into an accurate setting position and which includes its own separately driven member which operates on a cam affixed to the main shaft of the sewing machine.

A further object of the invention is to provide a device for accurately positioning a sewing machine main shaft and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 shows, a simplified side elevational view of the back of a sewing machine having the arrangement fo a device according to the invention;

FIG. 2 is an embodiment of the device shown, partly in section;

FIG. 3 is a view similar to FIG. 2 with the cam plate and the drive lever acting on it in another embodiment of the device in a first stopping position of the sewing machine; and FIG. 4 shows the parts from FIG. 3 in a second stopping position with their partially shown support plate and their drive means.

DESCRIPTION OF THE PREFERRED EMBODIMENTS

Referring to the drawings, in particular the invention embodied therein comprises a device which as shown in FIG. 1 is mounted on the exterior of a sewing machine which has a main shaft 1 within a sewing machine housing 2. The device provides means for accurately positioning the main shaft after the drive of the main shaft by its own positioning motor has stopped.

The main shaft 1 of the sewing machine 2 is driven by a positioning motor or stop motor 3 via a V belt 4 which is passed over a V belt pulley 5 secured on the drive shaft of motor 3 and over a V belt pulley 6 secured on the main shaft 1 of the sewing machine. From the main shaft 1 a needle bar 7, movable upwardly and downwardly is driven, which carries at its lower end the thread carrying needle 8, which cooperates for seam formation with a shuttle, not shown, disposed below the stitch plate 9 and likewise is driven by the main shaft 1. To hold the work down, a pressure foot 10 is fastened to the spring loaded presser bar 11.

The sewing machine 2 is equipped with a thread cutting device of known design, e.g. according to German Pat. No. 1,125,742. Due to the positioning motor 3 in conjunction with a synchronizer (not shown) disposed on the main shaft 1, it is possible to stop the sewing machine 2 at the end of a seam in needle-down position, then to initiate the thread cutting process, with the main shaft 1 executing approximately one half revolution, and at the end of the thread cutting process to stop the sewing machine 2 with the thread feeding lever TL up. This position is chosen because in this position the thread feeding lever has completed the thread pull-up and therefore exerts no pull on the thread in the following start-up of sewing. This deviates the possibility that the thread feeding lever pulls the thread end out of the eye of the needle.

To determine an additional stopping postion in the needle-up position, there is fastened onto an end of the main shaft 1 which extends out of the sewing machine housing, a cam plate 12, which has a cam portion 13 with a radial shoulder 14 and at an angular distance therefrom an additional radial shoulder 15. Cooperating with the radial shoulder 14 is a crowned driver cam 16 of a driving lever 17, which is guided for longitudinal displacement in a straightway guide 18 and is under the action of a compression spring 19 arranged in the guide 18. The guide 18 is machined in a housing 20 which also has a cylinder space 21 for a pneumatic piston 22, whose piston rod 23 is brought out through a bore in a sealing plug 24. The cylinder space 21 has on either side of the pneumatic piston 22 a hose nipple 25, 26 for connecting pneumatic hoses.

The threaded free end of the piston rod 23 is screwed into a coupling piece 27 and is secured by a lock nut 28. Protruding into a cross bore of the coupling piece 27 is a pin 29 secured to the drive lever 17. Due to this drive connection, the drive lever 17 is longitudinally displaceable in the straightway guide 18. The housing 20 with the parts disposed on it is secured to a support plate 30.

On a stay bolt 31 in the support plate 30, a two armed lever 32 is pivotably mounted which comprises an arm 33 with a spherical end 34 and an arm 35 with an angularly extending end 36. The spherical end 34 protrudes into a slot 37 in the drive lever 17, and the angularly extending end serves as stop for the shoulder 15 of the cam plate 12 and provides a counter stop for it. The lever 32 is under the action of the compression spring 38, which at one end is inserted into a bore in the support plate 30 and at the other end engages at arm 35.

The support plate 30 with these device parts is secured by screws 39 as a structural unit to the sewing machine housing in a position in which the drive lever 17, displaceable in the straightway guide 18, is inclined from the perpendicular and the shoulder 14 of cam 13 of cam plate 12 lies in the movement path of the driver cam 16 of the drive lever 17.

In FIGS. 3 and 4, a different embodiment of the cam plate and of its drive lever is shown. Instead of the cam plate 12, a cam plate 40 is fastened on the main shaft 1. In the rim of cam plate 40 is a notch 41, which is defined by a shoulder 42 on one side of a line M—M placed through the center of the notch 41 and the central axis of the cam plate 40. Contiguous to the limiting shoulder 43 of notch 41 opposite shoulder 42 is a counter stop 44 for a striking surface 46 provided at a drive lever 45. The stop surface 44 and a shoulder 42 enclose an approximately right angle.

The drive lever 45 is pivotable on a gudgeon 48 secured in a support plate 47 and has in addition to the top surface 46 a driver cam 49, which cooperates with the shoulder 42 of cam plate 40.

The drive lever 45 is actuated by a pneumatic cylinder 50 which is arranged on the support plate 47 and whose piston rod 51 is articulated to the drive lever 45 through an intermediate piece 52 by a hinge pin 53. The housing of the pneumatic cylinder 50 has a hose nipple 54 for connecting a pneumatic hose. The working piston 55 of the pneumatic cylinder 50 is under the action of a return spring 56. The support plate 47 with the device parts disposed on it is secured as a structural unit to the housing of the sewing machines by screws 57.

Mode of operation:

To prepare for the cutting of the threads, the sewing machine 2 is stopped at the end of a seam in needle-down position and thereafter is started by the operator to effect about one half revolution of the main shaft 1, to initiate the cutting process. During this partial rotation of the main shaft 7, the loop taker executes a complete revolution. The threads to be cut are seized by the thread catcher of the cutting device and are moved to a knife and cut off. Then the sewing machine 2 is stopped in the up position of the thread feeding lever. The needle bar 7 of sewing machine 2 has at that time already passed its upper reversal position and has moved downward by a certain distance, so that the passage space between the needle point and the stitch plate 9 is smaller than in the needle-up position so that handling of the work is hindered.

To turn the sewing machine 2 back from the thread feeding lever up position to the needle-up position, the working piston 22 in the cylinder space 21 of the housing 20 receives compressed air via the nipple 25.

Thereby, via the piston rod 23, the coupling piece 27 and the pin 29, the drive lever 17 is displaced obliquely downward in the straightway guide 18 counter to the action of compression spring 19. This releases the spherical end 34 of the pivoting lever 32 from the lower end of the slot 37 in the drive lever 17, so that the pivoting lever 32 is pivoted by the spring 38 clockwise about the stay bolt 31 and thereby stop 36 is moved into the path of the shoulder 15 serving as a counter stop.

The crowned driver cam 16 of the drive lever 17 comes into physical contact with the shoulder 14 on cam 13 of the cam plate 12, in the course of the downward movement of the drive lever 17 to rotate the main shaft 1 via the cam plate 12 by a certain angle in one direction of arrow R, that is, counter to the normal running direction of the sewing machine, arrow V, back into the needle-up position of the sewing machine 2. In this needle-up position, the parts which determine the stopping position block one another. The drive lever 17 is moved through the limiting face at the upper end of slot 37 in the drive lever 17 by the engagement of the spherical end 34, against the lever 17. Stop 36 is then engaged at shoulder 15 of cam 13 of cam plate 12. This urges plate 12 in the direction of the arrow V. This combined action results in accurate stopping of the needle.

To release the shoulders 14 and 15 and hence the main shaft 1 of the sewing machine for continued sewing, merely the working piston 22 of the drive lever 17 is admitted with compressed air via nipple 26, so that the drive lever 17 is moved upward into its starting position according to FIG. 2, the pivoting lever 32 being pivoted by the lower limiting face of slot 37 in the drive lever 17 counterclockwise and is likewise brought into its starting position illustrated in FIG. 2. The parts are held in this starting position by the compression spring 19.

With the embodiment according to FIGS. 3 and 4, in order to turn the sewing machine 2, stopped at the end of the thread cutting process in thread feeding lever up position according to FIG. 3, back into the needle-up position according to FIG. 4, the pneumatic cylinder 50 is pressurized via connection 43, whereby its piston rod 51 connected with the working piston 55 is displaced counter to the action of the return spring 56. In so doing, the drive lever 45 connected with the piston rod 51 by the intermediate piece 52 is pivoted counter clockwise about the gudgeon 48 from the angular position according in FIG. 3 into the angular position according to FIG. 4. In the pivoting movement the driver cam 49 comes in physical contact with the shoulder 42 of cam plate 40, rotating the latter with the mainshaft 1 counter to the running direction of the sewing machine, arrow V, back in the direction of arrow R into the needle-up position according to FIG. 4, in which the stop face 44 of cam plate 40 strikes against the counter stop face 46 at the drive lever 40, whereby the parts block themselves in this position. Thus a high stopping precision is achieved.

To release the shoulder 42 of cam plate 40 and hence the main shaft 1 for the next following sewing process, it suffices to vent the pneumatic cylinder 50. The drive lever 45 is then pivoted back by the compression spring 46 via the piston rod 51 connected with the working piston 56 and the intermediate piece 52 into the starting position according to FIG. 3 and is held there.

While specific embodiments of the invention has been shown and described in detail to illustrate the application of the principles of the invention, it will be understood that the invention may be embodied otherwise without departing from such principles.

What is claimed is:

1. A drive device for positioning a sewing machine main shaft driven by its own positioning motor into a first predetermined position when the main shaft is stopped in a second position, comprising a movable drive lever having a driver cam, a cam secured to the main shaft for rotation thereby having a cam shoulder motion disposed in the path of movement of said driver cam and a stop portion of said cam spaced circumferentially away from said shoulder portion, drive means associated with said drive lever to move said drive lever to engage said driver cam with said shoulder portion and to rotate said cam and the main shaft, and stop means engageable with said stop portion of said cam with the main shaft in a second predetermined position, said cam including a raised cam portion having a shoulder at one end forming said shoulder portion engageable with the driver cam of said drive lever and an opposite radially extending end defining said stop portion and including a two armed lever pivotally mounted alongside said drive lever and rotated thereby when said drive lever is moved to position a stop in the path of said portion of said cam.

2. A drive device for positioning a sewing machine main shaft driven by its own positioning motor into a first predetermined position when the main shaft is stopped in a second position, comprising a movable drive lever having a driver cam, a cam secured to the main shaft for rotation thereby having a cam shoulder portion disposed in the path of movement of said driver cam and a stop portion of said cam spaced circumferentially away from said shoulder portion, drive means associated with said drive lever to move said drive lever to engage said driver cam with said shoulder portion and to rotate said cam and the main shaft, and stop means engageable with said stop portion of said cam with the main shaft in a second predetermined position, and means for mounting said drive lever on said sewing machine, said means including a guideway for said drive lever, a spring biasing said drive lever into a disengaged position free from said cam and a fuid pressure operated piston movable in a cylinder of said guideway engaged with said lever and comprising said drive means for said lever.

3. A drive device for positioning a sewing machine main shaft which is driven by its own positioning motor into a first predetermined position when the main shaft is stopped in a second position, comprising a movable drive lever having a driver cam, a cam secured to the main shaft for rotation thereby having a cam shoulder portion disposed in the path of movement of said driver cam and a stop portion of said cam spaced circumferentially away from said shoulder portion, drive means associated with said drive lever to move said drive lever to engage said driver cam with said shoulder portion and to rotate said cam and the main shaft, and stop means engageable with said stop portion of said cam with the main shaft in a second predetermined position.

4. A device according to claim 3 wherein said first position comprises a needle-up position, said drive lever being movable to rotate said cam with the main shaft in an opposite direction to the direction said main shaft was rotating when it was driven and after the drive of the main shaft has ceased.

5. A drive device for positioning a sewing machine main shaft driven by its own positioning motor into a first predetermined position when the main shaft is stopped in a second position, comprising a movable drive lever having a driver cam, a cam secured to the main shaft for rotation thereby having a cam shoulder portion disposed in the path of movement of said driver cam and a stop portion of said cam spaced circumferentially away from said shoulder portion, drive means associated with said drive lever to move said drive lever to engage said driver cam with said shoulder portion and to rotate said cam and the main shaft, and stop means enageable with said stop portion of said cam with the main shaft in a second predetermined position, said first position comprises a needleup position, said drive lever being movable to rotate said cam with the main shaft in an opposite direction to the direction said main shaft was rotating when it was driven after the drive of the main shaft has ceased, a pivotal lever member mounted on a fixed axle and having two arms, one of which forming said stop means, engageable with said stop portion of said cam, said drive lever having a drive lever slot, in the other opposite arm of said pivotal lever member engaged in said drive lever slot, said drive lever being mounted in a guideway and being engageable with a top end of said slot when said drive lever is moved to rotate said cam.

* * * * *